United States Patent [19]

Den et al.

[11] 4,227,041

[45] Oct. 7, 1980

[54] FLAT TYPE FEEDER CABLE

[75] Inventors: Hiroshi Den; Masao Shimizu, both of Chiba; Yoshioki Shingo, Shizuoka, all of Japan

[73] Assignee: Fujikura Cable Works, Ltd., Tokyo, Japan

[21] Appl. No.: 961,093

[22] Filed: Nov. 16, 1978

[30] Foreign Application Priority Data

May 23, 1978 [JP] Japan ..... 53-61311

[51] Int. Cl.[2] ..... H01B 7/08

[52] U.S. Cl. ..... 174/117 F; 174/113 R; 174/117 R

[58] Field of Search ..... 174/117 R, 117 F, 113 R

[56] References Cited

U.S. PATENT DOCUMENTS 2,787,653 4/1957 Ormerod ..... 174/117 R

FOREIGN PATENT DOCUMENTS 2330673 12/1974 France ..... 174/117 F
50-21685 3/1975 Japan .
50-134682 11/1975 Japan .
51-120979 9/1976 Japan .
314882 11/1930 United Kingdom ..... 174/117
888536 1/1962 United Kingdom ..... 174/117

*Primary Examiner*—Richard R. Kucia
*Attorney, Agent, or Firm*—Armstrong, Nikaido, Marmelstein & Kubovcik

[57] ABSTRACT

A flat type feeder cable comprising an even number of stranded conductors and an outer jacket made of a flexible material wholly covering the stranded conductors, each of said stranded conductors being composed of a plurality of insulated cores stranded together, and wherein an equal number of the stranded conductors are disposed in a symmetrical relationship, characterized in that the direction of lay of each of the stranded conductors of half the number is right-hand while the direction of lay of each of the remaining stranded conductors is left-hand, and each of the plurality of insulated cores constituting each stranded conductor has one twist by one pitch of the stranding of the stranded conductor, said twist having the same direction as the direction of the stranding of the stranded conductor. The flat type feeder cable has excellent bending characteristic (flexibility), torsion resistance, compactness, resiliency and installing workability, and is useful espeically as a feeder cable for moving constructions such as elevators travelling in a limited space.

14 Claims, 32 Drawing Figures

FLAT TYPE FEEDER CABLE

The present invention relates to a flat type feeder cable for feeding electric power from a fixed electric power-supply terminal to a moving apparatus such as a stacking crane, an elevator or the like. More particularly, this invention relates to a flat type feeder cable for feeding electric power to a moving apparatus such as an elevator adapted to travel vertically in a narrow or restricted space.

A feeder cable connected to a moving, apparatus is generally called a moving cable. When in use after the installation such cable is repeatedly subject to various types of mechanical actions which cause bending, torsion and the like. Especially, in the case of an elevator which repeatedly moves vertically in a hoistway, the cable is suspended between a fixed electric power-supply terminal and the moving elevator with the intermediate portion of the cable being bent in a U-shape. In such an arrangement, the bent portion of the cable is caused to successively shift along its entire length thereof during such vertical movement. In this manner, the cable is continuously subjected to repeated bending action over its entire length. The cable must have excellent flexibility in order to withstand such repeated bending.

Flexibility has generally been imparted to feeder cables, including conventional round type cables, by forming a stranded conductor from insulated wherein a plurality of such cores are stranded in such a manner that the cores themselves have, (a) no twist in the direction of the stranding, or (b) have a twist in the reverse direction (hereinafter referred to as the "method of stranding with reverse twist").

If a stranded conductor is formed by stranding or cabling a plurality of cores in the above-mentioned manner the insulated cores constituting the stranded conductor are tightly fitted to one another so that the entire body of the cable containing the resulting stranded conductor is imparted with a predetermined degree of elasticity or flexibility. The resulting stranded conductor has such a tight fit of its component parts that a complicated procedure requiring much time is necessary to loose the strands and separate the insulated cores when attaching the stranded conductor to an electric terminal. Further, it is difficult to cancel the stranding tendency of the separated cores, and of the stranded conductor, the appearance thereof after it is attached to the electric power feeder terminal is poor. It is also difficult to gather the end portions of the respective insulated cores of such stranded conductor into one compact bundle and accommodate them in a junction box in an elevator's hoistway.

Soft polyvinyl chloride and the like are widely employed as insulating material for the cores of such cables because these polymers have desirable properties such as high flexibility, heat resistance and cold resistance. When the stranded conductor is formed by the "method of stranding with reverse twist" and a material such as soft polyvinyl chloride is employed as insulating material, flexibility is imparted to the cable, but a great twist resiliency restoring force which is imparted to the insulated cores which are tightly fitted to one another causes the insulating material to be deformed. Such deformation of the insulating material can cause the insulating material and, in some instances, the core wires themselves to break.

Further, it is noted that if clockwise and counter-clockwise torsions occur on an electric power feeder cable installed vertically in a suspended fashion in a narrow or limited space between an elevator cage and the side wall of the elevator hoistway, the cable may be caught on various structures or projections protruding from the wall of the elevator hoistway. This can cause the cable to collide with the side wall of the elevator cage and break. Hence, such the moving feeder cable is required to have excellent torsion-resistance as one of its mechanical properties so that torsion is not readily produced in the cable when the cable is suspended in a vertical disposition.

The present inventors have made intensive studies directed to eliminating all the above-mentioned disadvantages. They have succeeded in developing a flat type feeder cable which has excellent bending characteristics (flexibility), torsion-resistance, compactness, toughness and workability. These are properties which are necessary in a moving feeder cable for use with a moving apparatus (such as an elevator) located in a restricted space such as the hoistway of the elevator or the like.

Accordingly, it is an object of the present invention to provide a flat type feeder cable which has excellent bending characteristic (flexibility) and which can be installed in a hoistway or the like having less cable space than that required by a conventional round type feeder cable.

It is another object of the present invention to provide a flat feeder cable of the type described, which has a good balance between the torque in the clockwise direction and that in the counter-clockwise direction with respect to the central point of a cross section of the cable and which is not subject to torsion during the use thereof in a suspended disposition (e.g., in an elevator shaft or hoistway).

It is a further object of the present invention to provide a flat type feeder cable of the above character, which can be readily loosed at its stranded end portions of the insulated cores constituting the stranded conductor, thereby enabling the cable to be simply and securely connected to a junction box.

The foregoing and other objects, features and advantages of the present invention will be apparent to those skilled in the art from the following detailed description taken in connection with the accompanying drawings in which.

FIGS. 7A,7B,8A,8B,9A,9B,10A,10B,11A,11B,-12A,12B,13A,13B,14A, 14B,15A,15B,16A,16B,-17A,17B,18A, & 18B set forth other embodiments of flat type feeder cables with the A figures showing plan views and the B figures showing corresponding diagrammatic cross-sectional views of the A figures.

According to the present invention, there is provided a flat type feeder cable comprising an even number of stranded conductors with their respective axes arranged in a row and in a substantially coplanar relationship and an outer jacket made of a flexible material wholly covering the stranded conductors, each of said stranded conductors being composed of a plurality of insulated cores stranded together; and wherein an equal number of the stranded conductors are disposed in a symmetrical relationship with respect to the lateral axis of symmetry on a cross section of the cable, the direction of lay of each of the stranded conductors of half the number is right-hand while the direction of lay of each of the remaining stranded conductors is left-hand, and each of the plurality of insulated cores constituting each stranded conductor has one twist per one pitch of the stranding of the stranded conductor, said twist having the same direction as the direction of the stranding of the stranded conductor.

Figure 1:
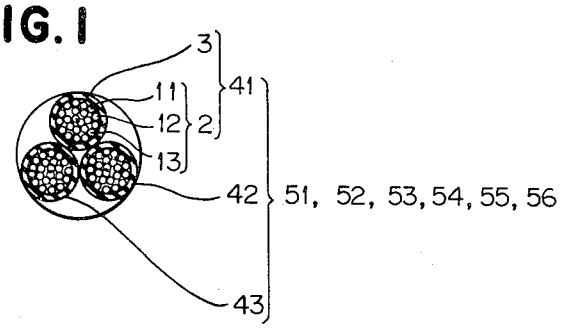
FIG. 1 shows a cross sectional view of one form of a stranded conductor used in a flat type feeder cable according to the present invention.

Referring now to FIG. 1, there is shown a cross sectional view of one form of a stranded conductor employed in a flat type feeder cable embodying the present invention. With reference to FIG. 1, a vast plurality of core wires 11, 12, 13 . . . are stranded. These core wires constitute an element conductor 2. The element conductor 2 is sheathed with an insulating material 3 such as soft polyvinyl chloride and the like to form an insulated core 41. In the same manner as mentioned above, insulated cores 42 and 43 are formed. A plurality of the thus formed insulated cores is stranded, thus forming a stranded conductor 51, and in the same manner, stranded conductors 52 to 56 are formed.

FIGS. 2 to 18 illustrate various forms of flat type cables of the present invention in which an even number of stranded conductors 51 to 56 are employed. As apparent from each of these figures, the even numbers stranded conductors are arranged in parallel, with their respective axes being in a substantially coplaner relationship; said stranded conductors 51 to 56 are wholly covered with an outer jacket 6 made of a flexible material such as rubber or polyvinyl chloride and the like. The arrangement of the stranded conductors 51 to 56 is further characterized in that an equal and even number of the stranded conductors are disposed in a symmetrical relationship with respect to the laterial axis of symmetry passing a central point X on a cross section of the cable. Further,, half of said stranded conductors have a right-hand direction of lay and half of them have a left-hand direction of lay. Each of the insulated cores constituting the stranded conductors 51 to 56 has one twist per one pitch of the stranding of the stranded conductor and said twist has the same direction as the direction of the stranding of the stranded conductor [reference: "Kosaku no Seizo" (Manufacturing of Stranded Wire) written by Tasaburo Nishioka and published by Seibundo Shinko-sha, Japan, pages 119 to 122]. Thus, there are provided flat type feeder cables 7 according to the present invention.

Figure 2A:
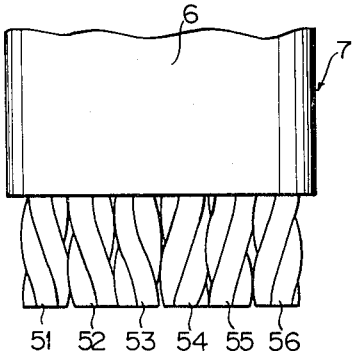
FIG. 2A shows a plan view of a flat type feeder cable.
Figure 3A:
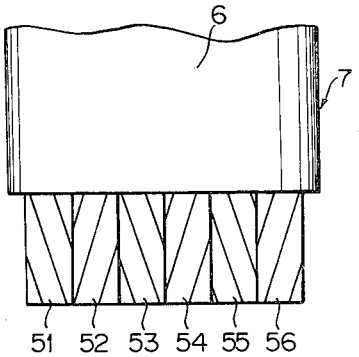
FIG. 3A shows a plan view of another type of flat feeder cable.
Figure 2B:
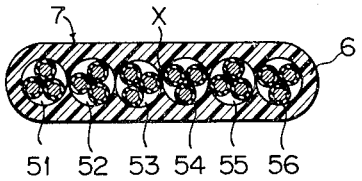
FIG. 2B shows a diagrammatic cross-sectional view of the cable of FIG. 2A.
Figure 3B:
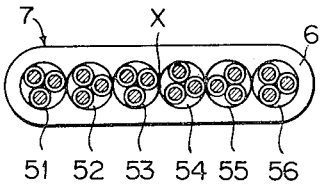
FIG. 3B shows a diagrammatic cross-sectional view of the cable of FIG. 3A.

The illustrative structure of one form of a flat type cable according to the present invention is shown in FIGS. 2A and 2B. The stranded conductors 51 to 56 are arranged in parallel and the respective two adjacent stranded conductors are in contact with each other. The direction of lay of each of the stranded conductors 51, 52 and 53 is right-hand while the direction of lay of each of the conductors 54, 55 and 56 is left-hand. The structure of another form of a flat type feeder cable shown in FIGS. 3A and 3B is similar to that shown in FIGS. 2A and 2B in that the stranded conductors 51 to 56 are arranged in parallel and the respective adjacent two stranded conductors are in contact with each other. However, this form of a cable is different from that shown in FIGS. 2A and 2B in that the direction of lay of each of the stranded conductors 51, 53 and 55 is right-hand while the direction of lay of each of the stranded conductors 52, 54 and 56 is left-hand.

Figure 4:
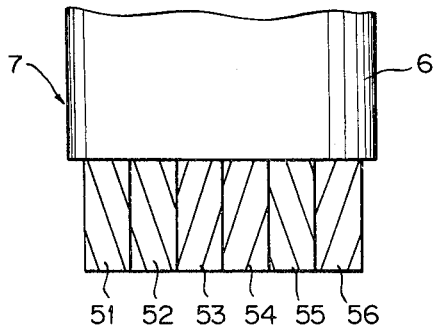
FIGS. 4 to 6 show plan views similar to the A views of other types of flat feeder cables.
Figure 5:
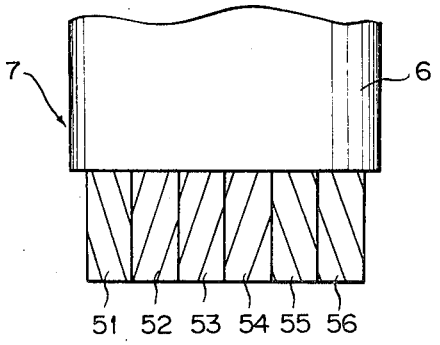
Figure 6:
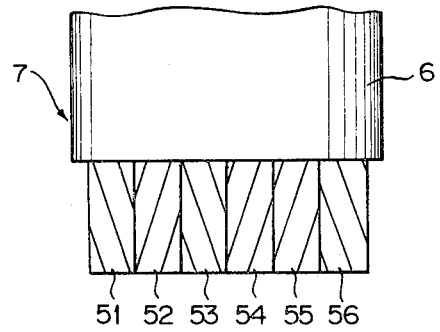
Figure 7A:
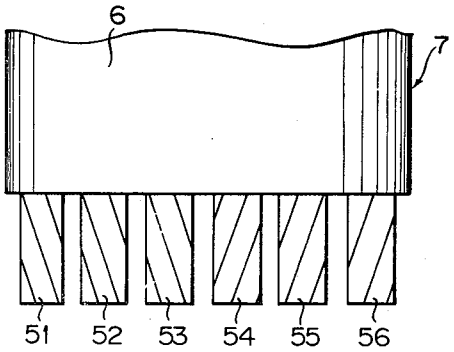

Each of the embodiments illustrated in FIGS. 4 through 6 has such a structure wherein the stranded conductors 51 to 56 are arranged in parallel and the respective two adjacent stranded conductors are in contact with each other, similarly to that of the embodiment shown in FIGS. 2A and 2B. However, in the feeder cable shown in FIG. 4, the direction of lay of each of the stranded conductors 51, 52 and 55 is right-hand and the direction of lay of each of the other conductors 53, 54 and 56 is left-hand. In the feeder cable illustrated in FIG. 5, the direction of lay of each of the stranded conductors 51, 55 and 56 is right-hand, and the direction of lay of each of the other stranded conductors 52, 53 and 54 is left-hand. In the feeder cable shown in FIG. 6, the direction of lay of each of the stranded conductors 51, 53 and 56 is right-hand and the direction of lay of each of the stranded conductors 52, 54 and 55 is left-hand.

Each of the embodiments illustrated in FIGS. 7A, 7B and 8A, 8B has substantially the same structure as each of the embodiments illustrated in FIGS. 2A, 2B and 3A, 3B except that the respective adjacent stranded conductors 51 to 56 are disposed at an interval L therebetween through the medium of a part of the outer jacket 6.

Figure 9A:
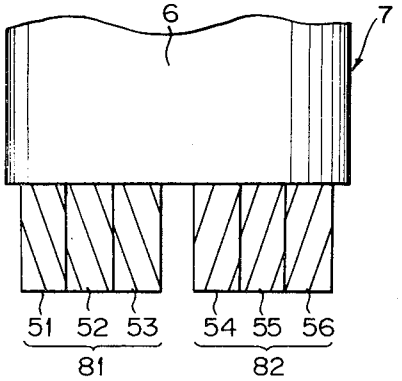
Figure 9B:
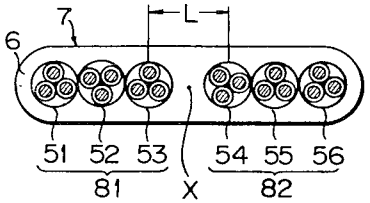

In the embodiment illustrated in FIGS. 9A and 9B, two groups 81 and 82 of stranded conductors consisting respectively of stranded conductors 51, 52 and 53 and stranded conductors 54, 55 and 56 are arranged in parallel in a row at a spacing L between the two groups as depicted. The respective adjacent stranded conductors in one group are in contact with each other. The direction of lay of each of the stranded conductors 51, 52 and 53 is right-hand while the direction of lay of each of the stranded conductors 54, 55 and 56 is left-hand. In the embodiment shown in FIGS. 10A and 10B, three groups 81, 82 and 83 of two neighboring stranded conductors, namely, stranded conductors 51 and 52, stranded conductors 53 and 54 and stranded conductors 55 and 56 are disposed in parallel. The two adjacent stranded conductors in one group are in contact with each other. The respective groups of 81, 82 and 83 are disposed at a spacing L therebetween. The direction of lay of each of the stranded conductors 51, 53 and 55 is right-hand while the direction of lay of each of the stranded conductors 52, 54 and 56 is left-hand.

Figure 10A:
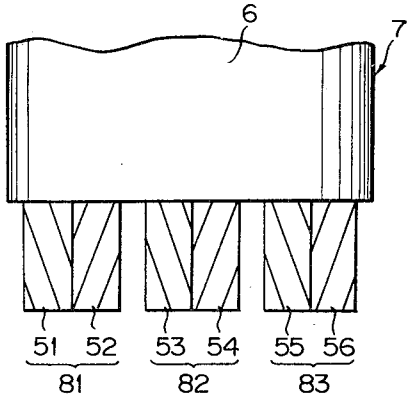
Figure 10B:
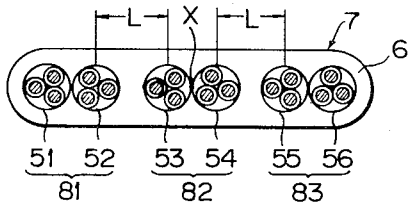
Figure 12A:
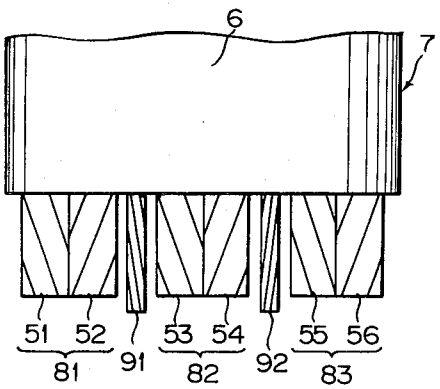
Figure 12B:
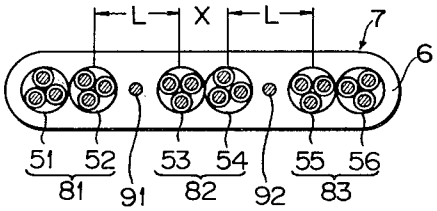
Figure 11A:
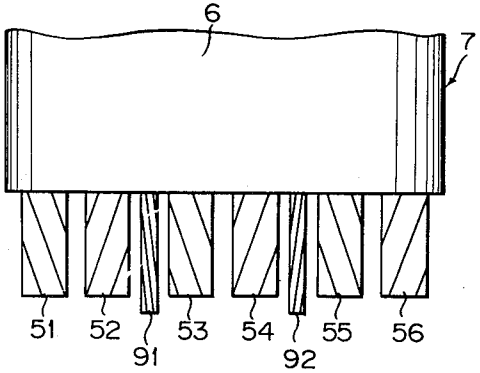
Figure 11B:
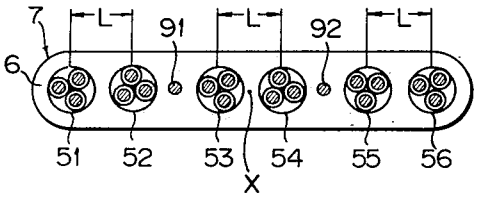

The flat type cable shown in FIGS. 11A and 11B as a further embodiment of the present invention is essentially the same as that shown in FIG. 8, with respect to the arrangement of stranded conductors. In this embodiment of FIGS. 11A and 11B, however, in an outer jacket 6 at its portions between stranded conductors 52 and 53 and between stranded conductors 54 and 55, reinforcement members or tension members 91, 92 are embedded longitudinally of the cable. The tension members 91, 92 are made of a material having a sufficient strength, for example a stranded steel wire, a steel strip, a fiber of organic material such as nylon, a fiber carbon. The embodiment illustrated in FIGS. 12A and 12B is substantially the same as that shown in FIG. 10, with respect to the arrangement of stranded conductors. In the embodiment of FIGS. 12A and 12B, reinforcement members or tension members 91 and 92 similar to those employed in the embodiment of FIGS. 11A and 11B are respectively buried, extending in a longitudinal direction of the cable in an outer jacket 6 at its portions between the two groups of stranded conductors 81 and 82, and between the two groups of stranded conductors 82 and 83.

The flat type feeder cables illustrated in FIGS. 11A, 11B and 12A, 12B may be advantageously employed as the cables of an elevator, when the elevator's travelling distance is more than about 60 m. Illustratively stated, because of the presence of the reinforcement members, the mechanical strength of the cable against tension exerted in a longitudinal direction of the cable is increased. Furthermore, the reinforcement member can be used as a suspension means for the elevator cable so that all the tension exerted on the cable is borne by the reinforcement member, thereby permitting the cable to be disposed in a suspended fashion with safety and without loading an excessive tension onto the insulated cores which are the conductor elements of the cable.

Figure 14A:
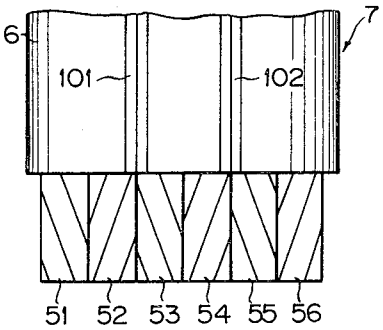
Figure 14B:
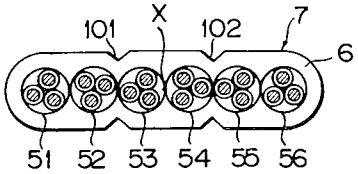
Figure 13A:
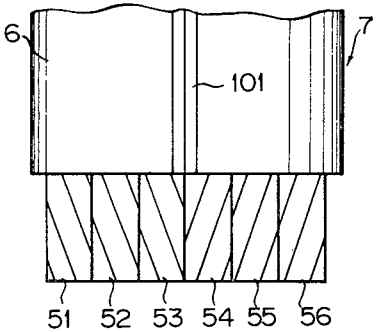
Figure 13B:
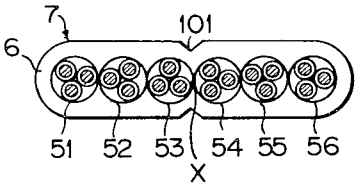

The embodiment illustrated in FIGS. 13A and 13B is substantially the same as that shown in FIGS. 2A and 2B. In this embodiment, on both surfaces of a jacket 6 at their respective portions corresponding to the contact portion of stranded conductors 53 and 54, are formed grooves 101 extending in a longitudinal direction of a cable 7. The embodiment shown in FIGS. 14A and 14B is substantially the same as that illustrated in FIGS. 3A and 3B. In the embodiment of FIGS. 14A and 14B, on both surfaces of a jacket 6 at their respective portions corresponding to the contact portions of stranded conductors 52 and 53 and of stranded conductors 54 and 55, there are formed grooves 101 and 102. In the structures of the embodiments mentioned above, when the outer jacket 6 is torn up along the grooves, the insulated cores of the adjacent stranded conductors positioned at the corresponding portion to the groove are, at the same time, exposed in the loosed state, so that the working efficiency may be enhanced and working can be easily done.

Figure 8A:
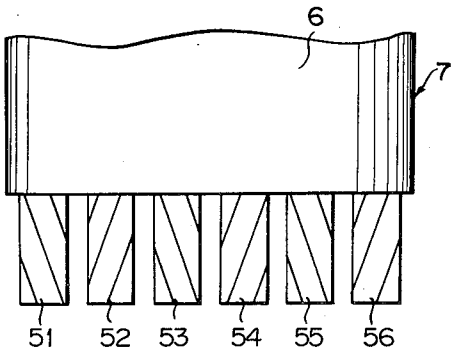
Figure 7B:
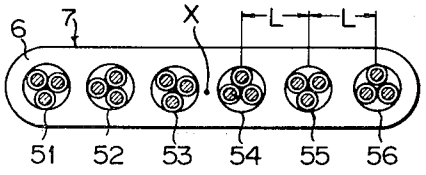
Figure 8B:
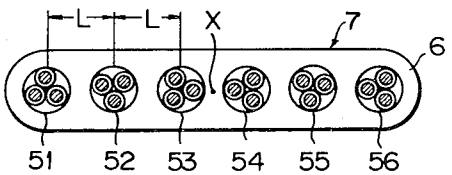
Figure 16A:
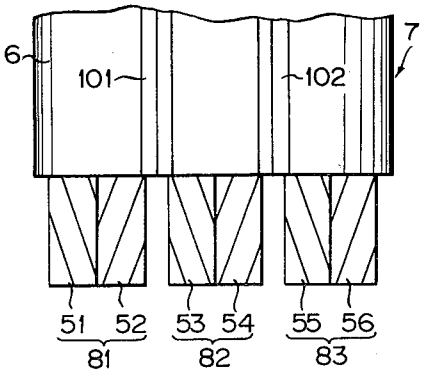
Figure 16B:
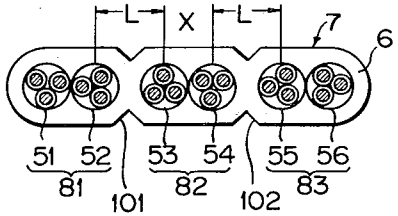
Figure 15A:
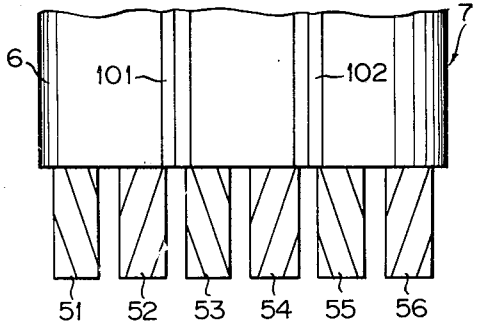
Figure 15B:
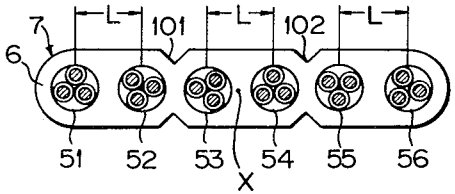
Figure 18A:
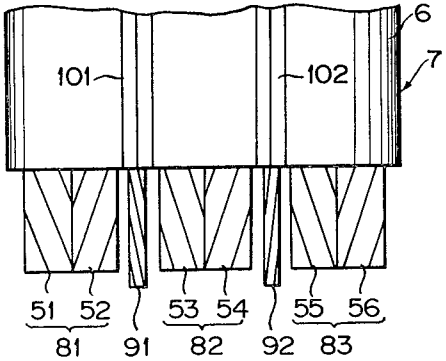
Figure 18B:
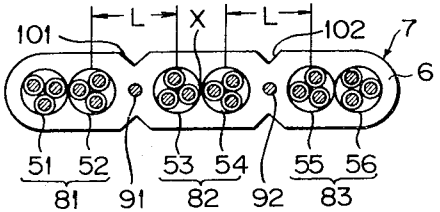

The embodiment illustrated in FIGS. 15A and 15B is substantially the same as that shown in FIGS. 8A and 8B. In this embodiment, there are formed grooves 101 and 102 extending longitudinally on both surfaces of a jacket 6. The grooves 101 and 102 are formed on both surfaces of a jacket 6 at their respective portions corresponding to the intermediate positions between stranded conductors 52 and 53 and between stranded conductors 54 and 55. The embodiment shown in FIGS. 16A and 16B is substantially the same as that illustrated in FIGS. 10A and 10B. In the instant embodiment, on both surfaces of a jacket 6 at their respective portions corresponding to the intermediate portions between two groups 81 and 82 of stranded conductors and between two groups 82 and 83 of stranded conductors, there are formed grooves 101 and 102 extending longitudinally of a cable 7. In the case of such a flat type feeder cable as mentioned above, the jacket can be torn along the grooves 101 and 102 by a simple operation of pulling-apart the respective adjacent sections in the jacket 6 defined by the grooves, so that the groups of the stranded conductors can be easily separated and an operation of connecting the stranded conductors to the junction box by way of group by group can be easily done.

Figure 17A:
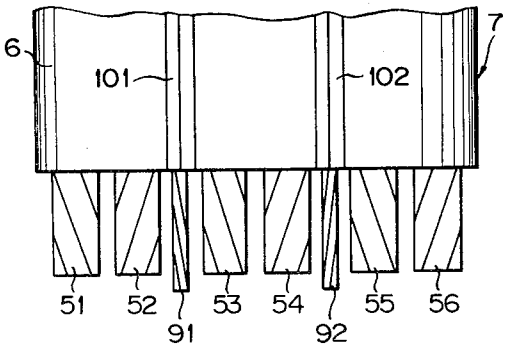
Figure 17B:
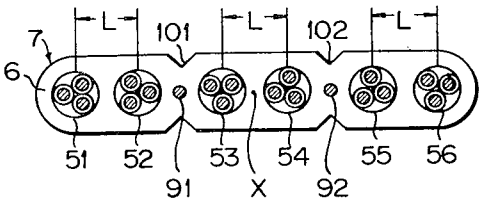

The embodiment shown in FIGS. 17A and 17B has such a structure that provision of reinforcement members as described in connection with FIGS. 11A and 11B and formation of grooves as described in connection with FIGS. 15A and 15B are made with respect to a flat type feeder cable as shown in FIGS. 8A and 8B. In a jacket 6 at its portions between stranded conductors 52 and 53 and between stranded conductors 54 and 55, reinforcement members 91 and 92 made of a material having a relatively high tensile strength are respectively buried in the longitudinal direction of a cable 7. On both surfaces of the jacket 6 at their respective portions corresponding to the positions where the reinforcement members 91 and 92 are buried, there are formed grooves 101 and 102 extending along the whole length of the cable 7. the embodiment illustrated in FIGS. 18A and 18B has such a structure that provision of reinforcement members as described in connection with FIGS. 12A and 12B and formation of grooves as described in connection with FIGS. 16A and 16B are made with respect to a flat type feeder cable as shown in FIGS. 10A and 10B. In a jacket 6 at its portions between the groups 81 and 82 of stranded conductors, and between the groups 82 and 83 of stranded conductors, reinforcement members 91 and 92 are respectively buried in the longitudinal direction of a cable 7. On both surfaces of the jacket 6 at their respective portions where the reinforcement members 91 and 92 are buried, there are formed grooves 101 and 102 extending along the whole length of the cable 7.

In the cases of the flat type cables of the structures shown in FIGS. 17A, 17B and 18A, 18B, it is understood that the flat type cable exhibits the same effect as that explained in connection with FIGS. 11 through 16. It is also apparent that when the end of the reinforcement member is exposed from the jacket and the exposed reinforced member is pulled upward along the groove, the jacket can be easily torn along the groove to separate the groups of the stranded conductors, enabling an operation of connecting the stranded conductors to the junction box by way of group by group to be easily done.

As a still further embodiment of the present invention, there can be mentioned a flat type feeder cable in which each of the stranded conductors 51 to 56 is composed of a plurality of insulated cores 41, 42 and 43 each containing an element core 2 that is formed by stranding a vast plurality of core wires 11, 12, 13 . . . in the same direction as the direction of the stranding of each of the stranded conductors 51 to 56. Alternatively, there can be mentioned a flat type feeder cable in which each of the stranded conductors 51 to 56 composed of a plurality of insulated cores 41, 42 and 43 each containing an element core 2 that is formed by stranding a vast plurality of core wires 11, 12, 13 . . . in the reverse direction to the direction of the stranding of each of the stranded conductors 51 to 56. In the just above explanation, reference is made to FIG. 1.

It is not clearly shown in FIGS. 1 to 18 showing various embodiments of the present invention, but it should be noted that each of the plurality of insulated cores constituting each stranded conductor has one twist per one pitch of the stranding of the stranded conductor and said twist has the same direction as the direction of the stranding of the stranded conductor, which is an indispensable feature of the present invention as described before (this feature is hereinafter referred to as "stranding with the same twist of insulated core").

In the cable of the present invention, the number of insulated cores is not limited to that shown in FIGS. 1 to 18, that is three. The number of the stranded conductors arranged in a row and in a coplanar relationship is not limited to that shown in FIGS. 1 to 18, that is six, but can be appropriately set at, e.g. two, four or more than eight insofar as the number is even. It is also understood that the spacing between the adjacent stranded conductors or the adjacent groups of stranded conductors may be appropriately set.

As described with reference to FIGS. 2 to 18 (in which like parts or portions are designated by like numerals or characters), according to the present invention, an even number of stranded conductors are arranged in parallel in a row in a coplanar relationship and the stranded conductors are wholly covered with a jacket made of a flexible material to form a feeder cable having a flat shape in cross section. Thus, the thickness of the cable is remarkably reduced with advantage. Therefore, even though each of the stranded conductors has a "stranding with the same twist of insulated core" that is inherently not good for imparting flexibility to a cable, the bending characteristics or flexibility is not impaired, so that good flexibility necessary for the cable to be bent to form a U-shape can be maintained. Furthermore, it should be noted that the bending characteristic or flexibility of the cable is excellent and far superior to that of a conventional round type feeder cable. In addition, since the thickness of the cable is reduced, the required number of flat type cables can be multi-laid one upon another with ease, so that a space necessary for installation of the cable can be greatly reduced. Therefore, the flat type cable of the present invention is excellently adapted as a moving feeder cable that is installed in a suspended state in an extremely restricted spacing between the inner wall of a hoistway and an elevator cage moving vertically upward and downward. Further, according to the present invention, equal numbers of the stranded conductors are disposed in a symmetrical relationship with respect to the lateral axis of symmetry on a cross section of the cable wherein the direction of lay of half of said stranded conductors is right-hand and the direction of lay of the remaining stranded conductors is left-hand. Hence, the moment of rotation produced in the cable by the stranding of half of the stranded conductors is offset by the action of the remaining stranded conductors which have the opposite direction of lay. Accordingly, the flat type feeder cable of the present invention has a good balance between the torque in the clockwise direction and that in the counter-clockwise direction with respect to the central point of a cross section of the cable and is not subject to torsion during use thereof in a vertically suspended state. In addition, since each of the stranded conductors has a "stranding with the same twist of insulated core", loosening the stranded conductor can be easily effected, so that an operation of connecting the cable to an electric power feeding terminal or a junction box and to a moving apparatus such as elevator can be easily accomplished. In other words the end portions of the cores can be easily loosened and, upon connection, can be readily accommodated in a compact junction box. In forming a stranded conductor for use in the present invention, as described previously, the insulated cores are stranded so as to have "stranding with the same twist of insulated core". The cable of this invention is superior to convention cables prepared by the "method of stranding with reverse twist" which has previously been considered to be indispensable for preparing flexible cables.

With the flat type cable of the present invention, all the afore-mentioned drawbacks have been overcome, and excellent bending characteristic (flexibility), torsion resistance, compactness, resiliency and installing workability (all of which are all necessary properties of a feeder cable used to supply electricity to a moving apparatus such as an elevator traveling vertically in a limited space) have been attained.

What is claimed is:

1. A flat type feeder cable useful for supplying electricity to an elevator comprising an even number of at least four stranded conductors with their respective axes arranged in a line and in a substantially coplanar relationship and an outer jacket made of a flexible material completely covering the stranded conductors, each of said stranded conductors being composed of a plurality of insulated cores stranded together, and wherein an equal number of the stranded conductors are disposed in a positionally symmetrical relationship with respect to the lateral axis of symmetry on a cross section of the cable, the direction of lay of each of half the number of stranded conductors is right-hand while the direction of lay of each of the remaining stranded conductors is left-hand, and each of the plurality of insulated cores constituting each stranded conductor has one twist per one pitch of the stranding of the stranded conductor, said twist having the same direction as the direction of the stranding of the stranded conductor.

2. A flat type feeder cable according to claim 1, wherein each of said plurality of insulated cores contains an element core consisting of a vast plurality of core wires stranded in the same direction as the direction of the stranding of said stranded conductor.

3. A flat type feeder cable according to claim 1, wherein each of said plurality of insulated cores contains an element core consisting of a vast plurality of core wires stranded in the reverse direction to the direction of the stranding of said stranded conductor.

4. A flat type feeder cable according to claim 1, wherein the respective adjacent stranded conductors of said stranded conductors are in contact with each other.

5. A flat type feeder cable according to claim 1, wherein the respective adjacent stranded conductors of said stranded conductors are arranged at a predetermined interval therebetween through the medium of the flexible material of the outer jacket.

6. A flat type feeder cable according to claim 1, wherein said even number of stranded conductors consists of at least two groups of stranded conductors, the respective adjacent stranded conductors in each group being in contact with each other, the respective adjacent groups of stranded conductors being arranged at a predetermined interval therebetween through the medium of the flexible material of the outer jacket.

7. A flat type feeder cable according to claim 5, which further comprises a reinforcement member buried in the outer jacket at its portion between the respective adjacent stranded conductors and extending longitudinally of the cable.

8. A flat type feeder cable according to claim 6, which further comprises a reinforcement member buried in the outer jacket at its portion between the respective adjacent groups of stranded conductors and extending longitudinally of the cable.

9. A flat type feeder cable according to claim 1, wherein the outer jacket has on its both surfaces at least one pair of grooves formed in an opposite relationship and extending longitudinally of the cable.

10. A flat type feeder cable according to claim 4, wherein the outer jacket has, on its both surfaces at their respective portions corresponding to the contact portion of the respective adjacent stranded conductors, grooves extending longitudinally of the cable.

11. A flat type feeder cable according to claim 5, wherein the outer jacket has, on its both surfaces at their respective portions corresponding to the intermediate portion between the respective adjacent stranded conductors, grooves extending longitudinally of the cable.

12. A flat type feeder cable according to claim 6, wherein the outer jacket has, on its both surfaces at their respective portions corresponding to the intermediate portion between the respective adjacent groups of stranded conductors, grooves extending longitudinally of the cable.

13. A flat type feeder cable according to claim 11, which further comprises a reinforcement member buried in the outer jacket at its portion corresponding to the grooves and extending longitudinally of the cable.

14. A flat type feeder cable according to claim 12, which further comprises a reinforcement member buried in the outer jacket at its portion corresponding to the grooves and extending longitudinally of the cable.

* * * * *